United States Patent [19]

Green

[11] 4,384,436

[45] May 24, 1983

[54] COMBINATION HURRICANE SHUTTER AND SECURITY GRILL

[76] Inventor: Michael A. Green, 922 NE. 199th. St. Apt. #105, North Miami Beach, Fla. 33179

[21] Appl. No.: 300,894

[22] Filed: Sep. 10, 1981

[51] Int. Cl.[3] ..... E06B 3/26

[52] U.S. Cl. ..... 52/202; 52/507; 52/509; 49/61

[58] Field of Search ..... 52/202, 507, 509, 489; 49/62, 50, 57, 463, 61

[56] References Cited

U.S. PATENT DOCUMENTS

| | | | |
|---|---|---|---|
| 915,588 | 3/1909 | Gehret | 52/202 X |
| 2,549,661 | 4/1951 | Carney | 189/78 |
| 2,631,698 | 3/1953 | Buckwalter | 49/62 |
| 2,668,729 | 2/1954 | Watters | 292/137 |
| 2,716,783 | 9/1955 | Fegan | 52/202 |
| 2,777,174 | 1/1957 | Carr | 49/61 X |
| 2,835,935 | 5/1958 | Housley | 52/202 X |
| 3,214,879 | 11/1965 | Ellingson, Jr. et al. | 52/202 X |
| 3,745,704 | 7/1973 | Covington | 49/57 |
| 3,861,081 | 1/1975 | Maskell | 49/70 |
| 3,871,434 | 3/1975 | Hance | 160/91 |
| 4,221,091 | 9/1980 | Ganse et al. | 49/61 X |
| 4,287,683 | 9/1981 | Louwenaar | 52/202 X |
| 4,333,271 | 6/1982 | De Paolo et al. | 52/202 X |

*Primary Examiner*—Carl D. Friedman

*Attorney, Agent, or Firm*—Oltman and Flynn

[57] ABSTRACT

A combination of a hurricane shutter and security grill intended for use in conjunction with a window of a commercial or residential building. The security grill comprises metallic bars of various shapes and dimensions which are combined in distinctive patterns in order to enhance the appearance of the building while allowing minimum obstruction to light rays. The security grill is located squarely in front of the window on the exterior side by means of ornamental brackets which are fixed to the longitudinal boundaries of the security grill and the structural side of the building. L-shaped brackets with functional or ornamental facing are fastened to the top and bottom latitudinal bars and provide channels to facilitate the insertion of a shutter board which completely encloses the security grill and the guarded window. The shutter board can be easily and quickly fastened to the front of the brackets with metallic wood screws in order to provide immediate protection in the advent of a surprise tropical storm or hurricane.

12 Claims, 8 Drawing Figures

COMBINATION HURRICANE SHUTTER AND SECURITY GRILL

BACKGROUND OF THE INVENTION

The combination of a hurricane shutter and security grill is becoming a necessity in the southeast United States. The increased propensity for criminal elements to accumulate in these states is nationally renowned from criminal statistics. Home and commercial burglaries have reached an all time high and are continuing to rise in these states. The necessity of a security grill to secure each and every window is well established by the demand expressed for this device.

In addition the southeastern states have visited upon them annually tropical storms and hurricanes which add to the tenuous situation. The property owner must protect his interests against both acts of man and nature. In order to reduce these twin burdens, the property owner requires a double duty device to provide security and safety against these acts. The invention presented herein provides the answer to this need by supplying in one apparatus a security grill which upon the demands of the weather can be converted into a hurricane shutter to ward off the elements.

While it does not appear that a combination of hurricane shutter and security grill has been proposed several patents have been issued on security grills or storm shutters.

For example, U.S. Pat. No. 3,745,704 to Covington illustrates a storm shutter installation of an apparatus which provides only storm protection to glass windows. Channels are affixed to the building adjacent to the upper and lower parts of the window and a panel is inserted into the channels with means provided for tightly grasping the panel in the lower channel.

U.S. Pat. No. 2,668,729 to Watters shows a retaining device which provides open work guards for windows accomplished by securing devices each having a base or body portion made fast to the building by bolts or other suitable locking means.

U.S. Pat. No. 3,871,434 to Hance details a security screen with supporting frame for installation over a conventional metal window casing. The device encompasses a metal frame supporting a heavy diamond mesh screen provided with a wrap-around flange about its periphery permitting it to be slipped over the edges of the metal window casing where it is secured by its clamping screws.

U.S. Pat. No. 2,549,661 to Carney demonstrates a storm protection window brace. The device consists of plurality of intercrossing structural members having rubber strips attached beneath each member, extending co-extensive with the length thereof and in contact with the window glass and being in complementary spaced relationship on alternate sides of the window glass so as to strengthen the window glass and dampen vibrations occurring therein by subdividing the window brace into a substantially checker-boarded pattern of reinforced areas.

U.S. Pat. No. 3,861,081 to Maskell shows a flood barrier intended for use in conjunction with the doorways of homes. The barrier comprises a U-shaped channel structure, the legs of which are secured either to the walls of the home immediately adjacent to a door frame or to inner faces of the door opening, with the back of the U extending across the door sill.

SUMMARY OF THE INVENTION

The present invention combines the features of a hurricane shutter and a security grill into one embodiment. The device features a metal framing having decorative metal bars of various dimensions and diverse shapes affixed to the metallic frame. The frame and metal bars can be formed by a casting process and finished through the employment of a forge. The open work is arranged to allow maximum light to pass but not allow a human form to traverse. Metallic support brackets formed by the same process in the shape of a fleur-de-lis are affixed to the extreme corners of the longitudinal extension of the framing. Openings are located in the top center of each bracket in order to secure the hurricane shutter and security grill to the exterior adjacent area of window in a residential or commercial building. The present invention offers maximum security with a decorative effect while not diminishing the light potential emanating from the window.

L-shaped guide channels are affixed to the metallic frame in the same manner as the metallic support brackets with two top channels affixed to the maximum latitudinal projection of the frame and two bottom channels affixed to the minimum longitudinal projection of the frame. Metallic ornamental supports are affixed to the front of the L-shaped guide channels. These metallic ornamental supports are either the same design as the fleur-de-lis which fastens the frame to the wall or in a functional square design which has additional support in the center of both frame projections.

When required hurricane panels of wood, plywood or other readily available material are slidably received into these channels from either side of the frame and are fastened to the channel brackets by means of metallic wood screws which pass through openings in the center top of the ornamental supports. The grillwork, openwork and window are completely battened down to receive the full effects of a tropical storm or hurricane with a minimum amount of notice and effort.

Further objects and advantages of this invention will be apparent from the following detailed description of a presently preferred embodiment thereof, shown in the accompanying drawings.

Before explaining the disclosed embodiments of the present invention in detail, it is to be understood that the invention is not limited in its application to the details of the particular arrangement shown since the invention is capable of other embodiments also, the terminology used herein is for the purpose of description and not of limitation.

Figure 1:
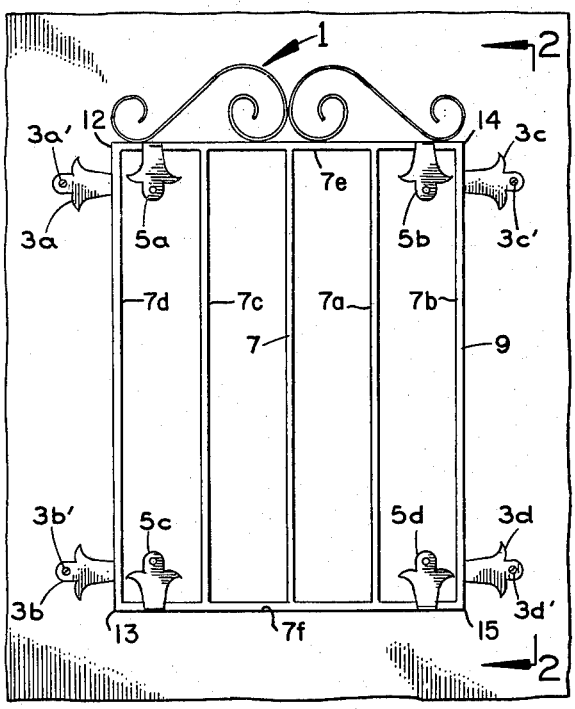
FIG. 1 is a front view of the hurricane shutter and security grill which exhibits brackets and supports in the form of a fleur-de-lis.
Figure 2:
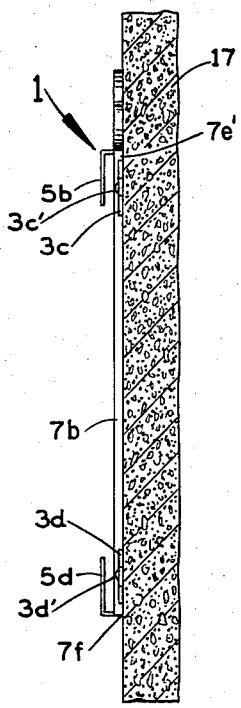
FIG. 2 is a cross-sectional view taken along 2—2 of FIG. 1 exhibiting the hurricane shutter and security grill secured to an exterior building surface.

FIGS. 1 and 2 show one embodiment of the hurricane shutter and security grill 1. This embodiment illustrates a metallic framework 9 having five laterally spaced vertical bars 7, 7*a*, 7*b*, 7*c* and 7*d*, which are its longitudinal frame members, and horizontal bars 7*e* and 7*f* at the top and bottom, which are joined to the ends of the vertical bars and are the framework's latitudinal frame members. The end bars 7*b* and 7*d* are remote longitudinal projections of the framework. The top and bottom bars 7*e* and 7*f* are top and bottom latitudinal projections of the framework. The vertical bars of the framework are close enough to each other to prevent a human body from passing between them but far enough apart so as not to filter out any light. Ornamental fleur-de-lis shaped metallic brackets 3*a*, 3*b*, 3*c* and 3*d* located on the extreme longitudinal corners 12, 13, 14 and 15 of the metal framing 9 are utilized to fasten the hurricane shutter and security grill 1 to the exterior portions of a building 17 which surround a residential or commercial window. Openings 3*a*'', 3*b*'', 3*c*'' and 3*d*'' are placed in the top center of the respective fleur-de-lis brackets and anchor bolts 3*a*', 3*b*', 3*c*' or 3*d*' are utilized to anchor the hurricane shutter and security grill 1 to the exterior wall 17.

Figure 4:
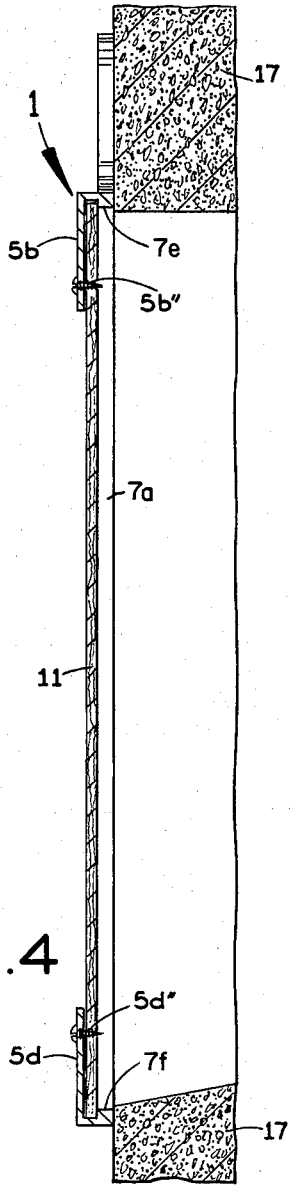
FIG. 4 is a cross-sectional view taken along 4—4 of FIG. 3 exhibiting a weatherized hurricane shutter and security grill secured to an exterior building structure.
Figure 3:
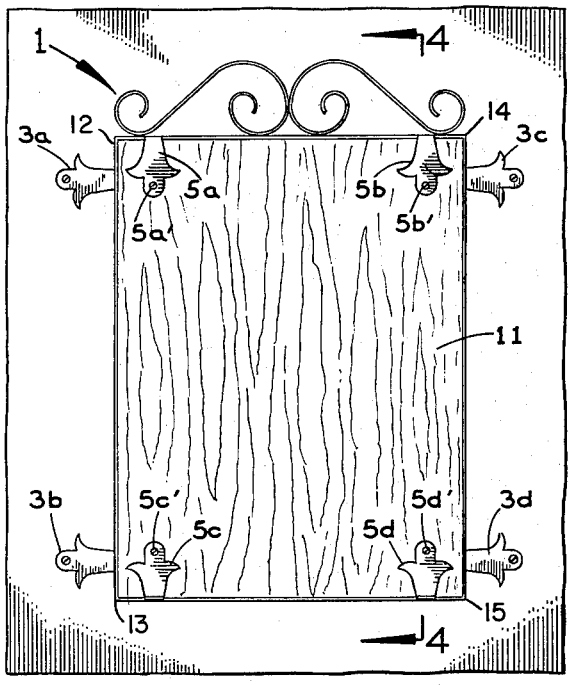
FIG. 3 is the same view as FIG. 1 with a hurricane panel secured in the hurricane shutter and security grill.
Figure 5:
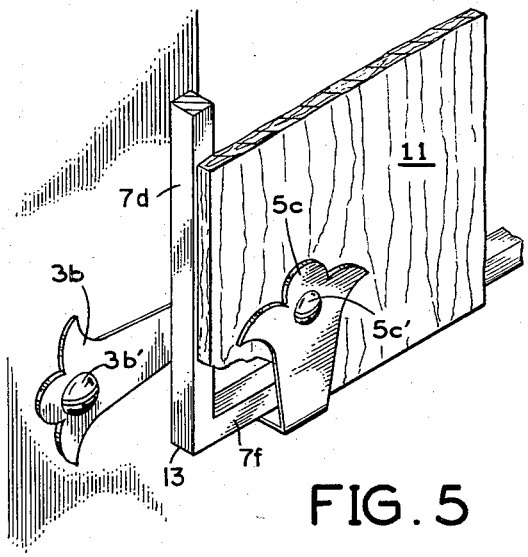
FIG. 5 is a fragmentary perspective view of a hurricane panel secured to the bottom channel of the hurricane shutter and security grill by means of fleur-de-lis supports.

FIGS. 3, 4 and 5 show the hurricane shutter and security grill 1 as it would appear awaiting a hurricane or tropical storm. L-shaped guide brackets 5*a*, 5*b*, 5*c* and 5*d* are affixed to the extreme latitudinal corners of the metallic frame 9. The front of the L-brackets have a fleur-de-lis pattern with respective openings 5*a*'', 5*b*'', 5*c*'' and 5*d*'' located in the top center of the fleur-de-lis. Hurricane panel 11 on notice of an upcoming tropical storm or hurricane is easily and quickly received through the L-brackets 5*a*, 5*b*, 5*c* and 5*d* from the side of the metallic frame 1 and fastened to these brackets by means of metallic wood fastening screws 5*a*', 5*b*', 5*c*' and 5*d*'.

Figure 6:
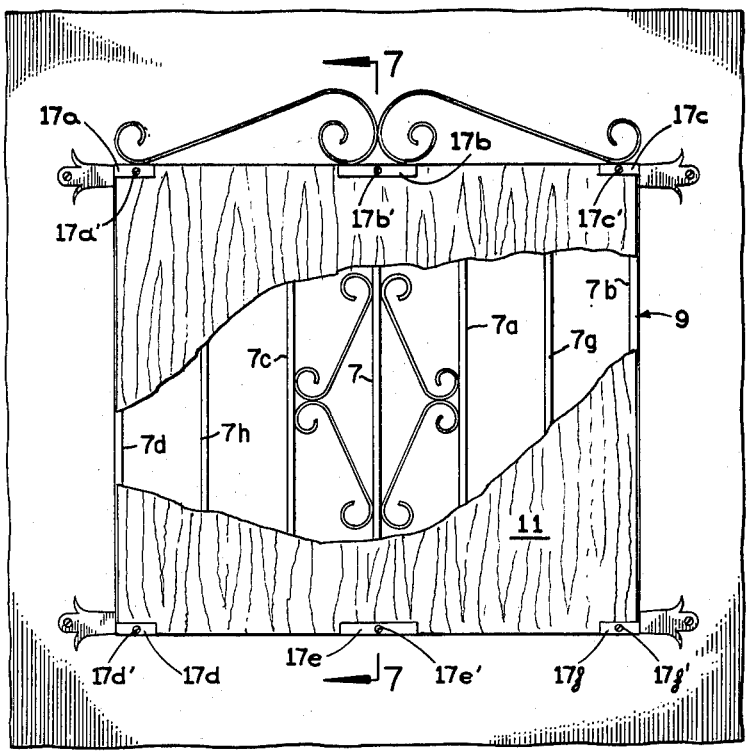
FIG. 6 is a cut-away front view of a hurricane shutter and security grill which exhibits functional square brackets to secure the hurricane panel.
Figure 8:
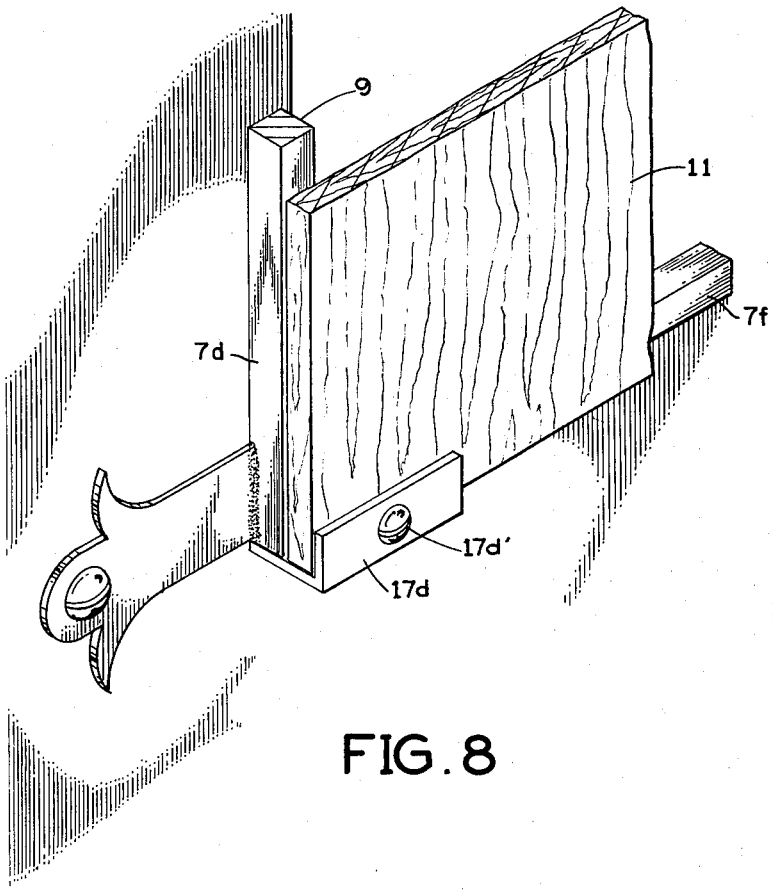
FIG. 8 is a fragmentary perspective view of a hurricane panel secured to the bottom channel of the hurricane shutter and security grill by means of functional square supports.
Figure 7:
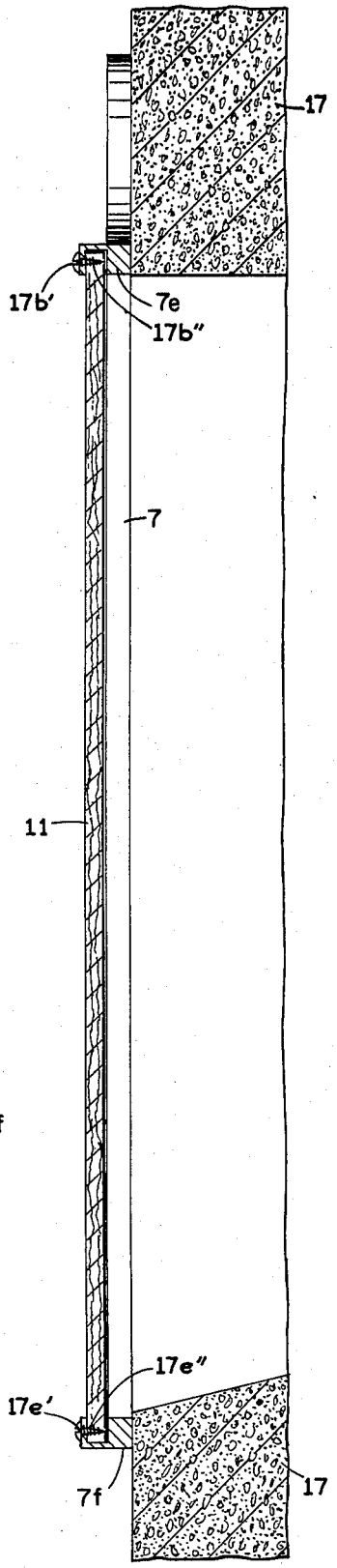
FIG. 7 is a cross-section view taken along 7—7 of FIG. 6 exhibiting the hurricane shutter and security grill secured to an exterior building surface utilizing the functional square supports to secure the hurricane panel.

FIGS. 6, 7 and 8 illustrate another embodiment of the same invention with corresponding elements assigned the same reference numbers. The framework has an additional vertical bar 7*g* located midway between vertical bars 7*a* and 7*b*, and an additional vertical bar 7*h* located midway between vertical bars 7*c* and 7*d*. L-brackets 17*a*, 17*b*, 17*c*, 17*d*, 17*e* and 17*f* are affixed to the extreme latitudinal corner of the metallic frame 9 and to the center section of the top and bottom latitudinal bars. The front of the L-brackets have a functional square pattern with the L-brackets 17*b* and 17*e* located at the top and bottom center sections, respectively, projecting an extended longitudinal dimension. The frontal square pattern of the L-shaped brackets have openings 17*a*'', 17*b*'', 17*c*'', 17*d*'', 17*e*'' and 17*f*'' tapped through their center sections. Hurricane panel 11 on notice of an upcoming tropical storm or hurricane is easily and quickly received in the L-brackets 17*a*, 17*b*, 17*c*, 17*d*, 17*e* and 17*f* from the side of the metallic frame 1 and securely fastened to these brackets by means of metallic wood fastening screws 17*a*', 17*b*', 17*c*', 17*d*', 17*e*' and 17*f*'.

From the foregoing, it will be evident that the present invention constitutes a novel, unique and convenient means of providing security against crime and hurricanes in an area of the country in need of such a device. The device is affixed to the exterior surface of a building with a minimum of dislocation and the hurricane panels can be inserted through the L-brackets with a minimum of effort. In all embodiments the materials selected can vary according to their availability, cost or structural requirements of the various elements.

I claim:

1. A hurricane shutter and security grill composed of ornamental metallic bars of various shapes and dimensions which are combined in distinctive and permanent patterns in order to enhance the exterior of a window of a residential or commercial building while allowing the maximum penetration of light rays through the openwork, the hurricane shutter and security grill comprises:

a metallic framework means having remote longitudinal projections and top and bottom latitudinal projections to adhere said ornamental metallic bars in a manner which will not allow a human form to traverse said ornamental metallic bars within the openwork of said metallic framework means and to define the outermost dimensions of said hurricane shutter and security grill;

structural ornamental fastener bracket means engaged to the remote longitudinal projections of said metallic framework in order to fasten said hurricane shutter and security grill to the exterior surface of a building or the framework immediately adjacent to said window;

L-shaped guide channel means having a horizontal backside and a vertical frontside, the horizontal backside fastened to the top and bottom latitudinal projections of said metallic framework means with metallic ornamental support means fastened to the vertical front side of said L-shaped guide channel means; and an insertable hurricane shutter which is received from the side into said hurricane shutter and security grill and upon traversing said hurricane shutter and grill encloses the latter from the elements and is fastened to said metallic framework means through said metallic ornamental support means.

2. A hurricane shutter and security grill as in claim 1, in which said metallic ornamental support means comprise a square design spaced upon the front sides of said L-shaped guide channels, said metallic ornamental support means having support openings passing through the top center of said metallic support means and said support openings accommodate metallic wood screws in order to secure said hurricane panel to said metallic framework to withstand wind gusts typified by the extremes of a hurricane or tropical storm.

3. A hurricane shutter and security grill as in claim 2, in which said L-shaped guide channel means are located at the extreme end and center sections of the highest and lowest latitudinal projections of said metallic framework.

4. A hurricane shutter and security grill as in claim 3, in which said L-shaped guide channel means located at the top and bottom center sections have an increased longitudinal projection over said L-shaped guide channel means located at the end sections.

5. A hurricane shutter and security grill as in claim 1, in which said metallic ornamental support means comprise a fleur-de-lis design spaced upon the front sides of said L-shaped guide channels, said metallic ornamental support means having support openings passing through the top center of said metallic ornamental support means and said support openings accommodating metallic wood screws in order to secure said hurricane panel to said metallic framework to withstand wind gusts typified by the extremes of a hurricane or tropical storm.

6. A hurricane shutter and security grill as in claim 5, in which said L-shaped guide channel means are located at the extreme end sections of the highest and lowest latitudinal projections of said metallic framework.

7. A hurricane shutter and security grill as in claim 1, in which said structural fasteners bracket means comprises a fleur-de-lis design with a structural fastener opening passing through the top center of said structural ornamental fastener bracket means and said structural fastener opening accommodating a structural fastener means which anchors said hurricane shutter and security grill to an exterior wall of a building or the framing of a window.

8. A hurricane shutter and security grill as in claim 7, in which said structural fastener means is an anchor bolt.

9. A hurricane shutter and security grill as in claim 1, in which said metallic framework means comprises cast iron or other castable and forgeable ferrous metals.

10. A hurricane shutter and security grill as in claim 1, which said hurricane shutter and security grill comprises said metallic framework means, said structural fastener bracket means, L-shaped guide channel means and metallic ornamental support means joined by joining means.

11. A hurricane shutter and security grill as in claim 1, in which said insertable hurricane shutter is fashioned from wood.

12. A hurricane shutter and security grill as in claim 1, in which said insertable hurricane shutter is fashioned from plywood.

* * * * *

US004384436B1

REEXAMINATION CERTIFICATE (2089th)

United States Patent [19]

Green

[11] B1 4,384,436

[45] Certificate Issued Sep. 14, 1993

[54] COMBINATION HURRICANE SHUTTER AND SECURITY GRILL

[76] Inventor: Michael A. Green, 922 NE. 199th St. Apt. #105, North Miami Beach, Fla. 33179

Reexamination Request:
No. 90/002,611, Jan. 2, 1992

Reexamination Certificate for:

| | |
|---|---|
| Patent No.: | **4,384,436** |
| Issued: | **May 24, 1983** |
| Appl. No.: | **300,894** |
| Filed: | **Sep. 10, 1981** |

[51] Int. Cl.[5] ..... E06B 3/26
[52] U.S. Cl. ..... 52/202; 49/61; 52/507; 52/509

[56] References Cited

U.S. PATENT DOCUMENTS

| | | |
|---|---|---|
| 915,588 | 3/1909 | Gehret . |
| 2,549,661 | 4/1951 | Carney . |
| 2,668,729 | 2/1954 | Walters . |
| 2,716,783 | 9/1955 | Fegan . |
| 2,777,174 | 1/1957 | Carr . |
| 2,835,935 | 5/1958 | Housley . |
| 3,214,879 | 11/1965 | Ellingson, Jr. et al. . |
| 3,745,704 | 7/1973 | Covington . |
| 3,861,081 | 1/1975 | Maskell . |

OTHER PUBLICATIONS

Security Bars with Free Hurricane Protection Panels newspaper advertisement, TV section Miami Herald, published Aug. 3, 1980.

*Primary Examiner*—Carl D. Friedman

[57] ABSTRACT

A combination of a hurricane shutter and security grill intended for use in conjunction with a window of a commercial or residential building. The security grill comprises metallic bars of various shapes and dimensions which are combined in distinctive patterns in order to enhance the appearance of the building while allowing minimum obstruction to light rays. The security grill is located squarely in front of the window on the exterior side by means of ornamental brackets which are fixed to the longitudinal boundaries of the security grill and the structural side of the building. L-shaped brackets with functional or ornamental facing are fastened to the top and bottom latitudinal bars and provide channels to facilitate the insertion of a shutter board which completely encloses the security grill and the guarded window. The shutter board can be easily and quickly fastened to the front of the brackets with metallic wood screws in order to provide immediate protection in the advent of a surprise tropical storm or hurricane.

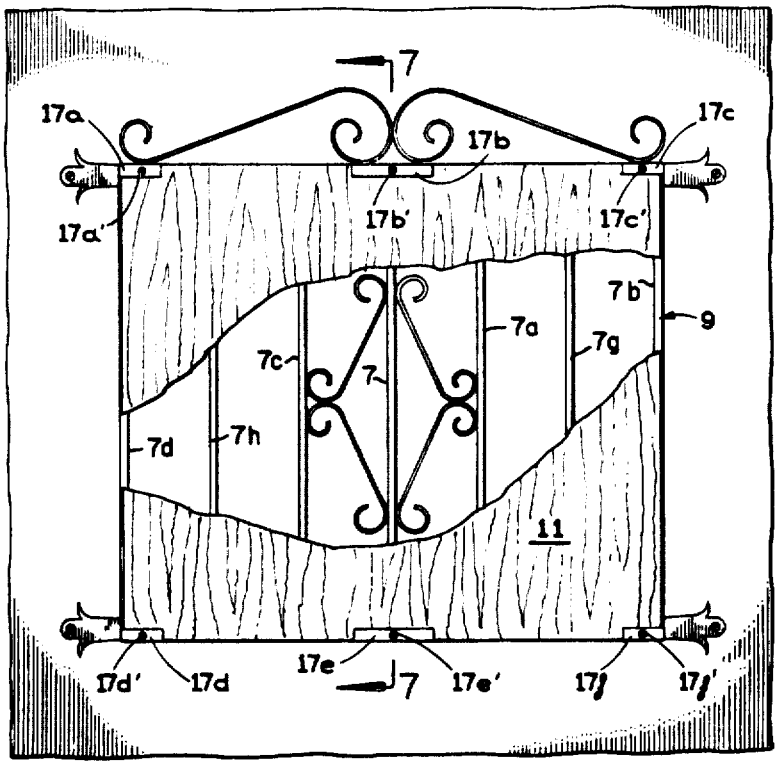

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-12 are cancelled.

* * * * *